US005685486A

United States Patent [19]

Spenser

[11] Patent Number: 5,685,486

[45] Date of Patent: Nov. 11, 1997

[54] ROTARY SPRINKLER

[75] Inventor: Benjamin Spenser, Zichron-Jaacob, Israel

[73] Assignee: Dan Mamtirim, Limited Partnership, Hagalil Halion, Israel

[21] Appl. No.: 388,356

[22] Filed: Feb. 14, 1995

[30] Foreign Application Priority Data

Feb. 16, 1994 [IL] Israel ..... 108663

[51] Int. Cl.[6] ..... B05B 3/16

[52] U.S. Cl. ..... 239/242; 239/240

[58] Field of Search ..... 239/206, 242, 239/240, 237

[56] References Cited

U.S. PATENT DOCUMENTS

| | | | |
|---|---|---|---|
| 4,625,914 | 12/1986 | Sexton et al. | 239/206 |
| 4,773,595 | 9/1988 | Livne | 239/242 |
| 4,901,924 | 2/1990 | Kah, Jr. | 239/242 |
| 5,031,833 | 7/1991 | Alkalay et al. | 239/68 |
| 5,086,977 | 2/1992 | Kah, Jr. | 239/206 X |
| 5,115,977 | 5/1992 | Alkalay et al. | 239/68 |
| 5,148,991 | 9/1992 | Kah, Jr. | 239/242 |
| 5,174,501 | 12/1992 | Hadar | 239/206 X |
| 5,330,103 | 7/1994 | Eckstein | 239/242 |

FOREIGN PATENT DOCUMENTS

| | | |
|---|---|---|
| 0 489 679 | 6/1992 | European Pat. Off. . |
| 2 684 568 | 6/1993 | France . |
| 76281 | 4/1991 | Israel . |
| 94/22588 | 10/1994 | WIPO . |

*Primary Examiner*—Lesley D. Morris
*Attorney, Agent, or Firm*—Helfgott & Karas, P.C.

[57] ABSTRACT

A rotary drive sprinkler comprising a housing for coupling to an irrigation water supply, a sprinkler spray head rotatably mounted with respect to the housing and flow coupled to supply and a rotary drive mechanism located within the housing so as to be driven by the water supply and a transmission mechanism coupled to the drive mechanism and having first and second, oppositely directed, rotary outputs, there being further provided a reversing mechanism including a stop assembly having stop members arcuately displaceable with respect to each other between a juxtaposed position and a variable spaced apart position, a trip assembly responsively juxtaposed with respect to the stop members so as to be reversibly displaced by successive contacting with the stop members only when the latter are in their angularly spaced apart position, one of the assemblies being rotationally driven by the drive mechanism and a selective coupling responsively coupled to the trip assembly for coupling to one or other of outputs respectively in response to the reversible displacement of trip assembly and a drive member coupled, on the one hand, to spray head and, on the other hand, to the coupling so as to be rotationally driven about a drive axis.

17 Claims, 10 Drawing Sheets

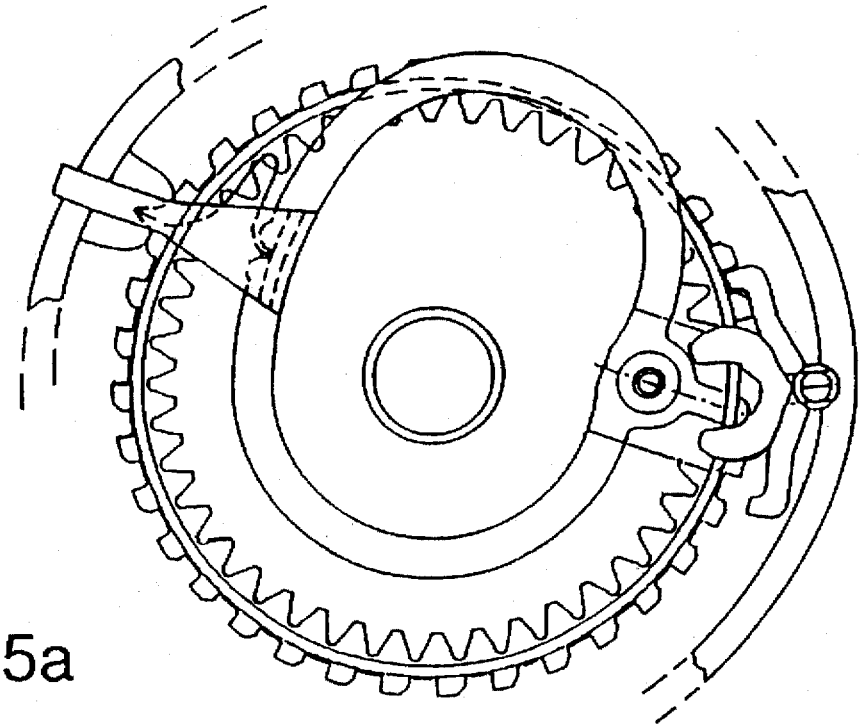
Fig.5a
Fig.5b
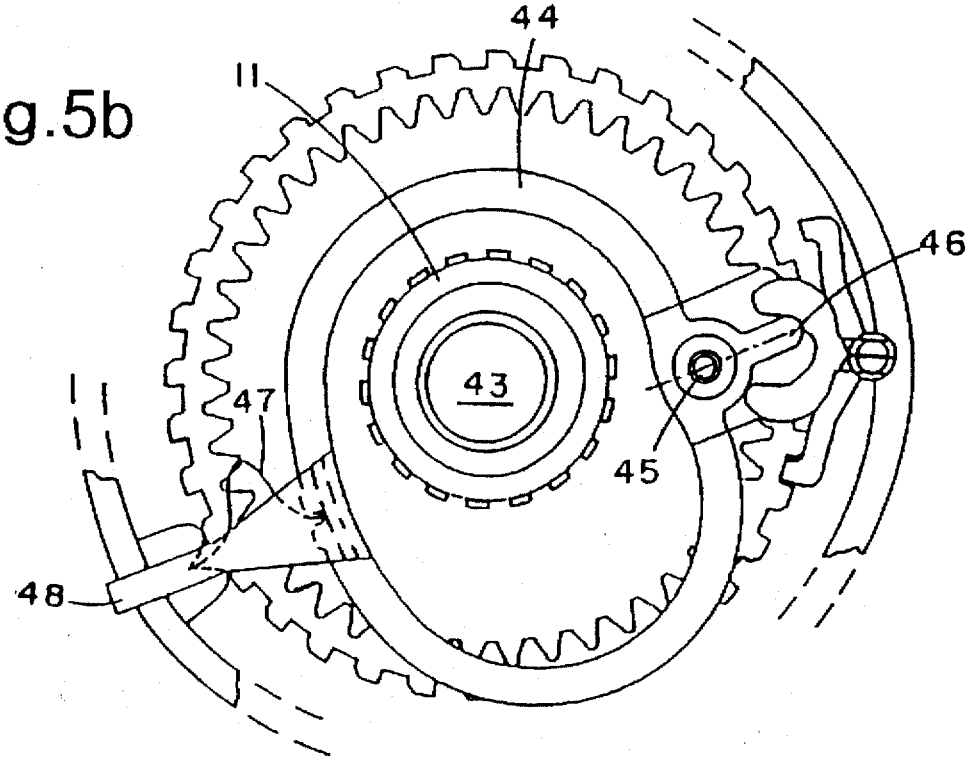

Fig.7a
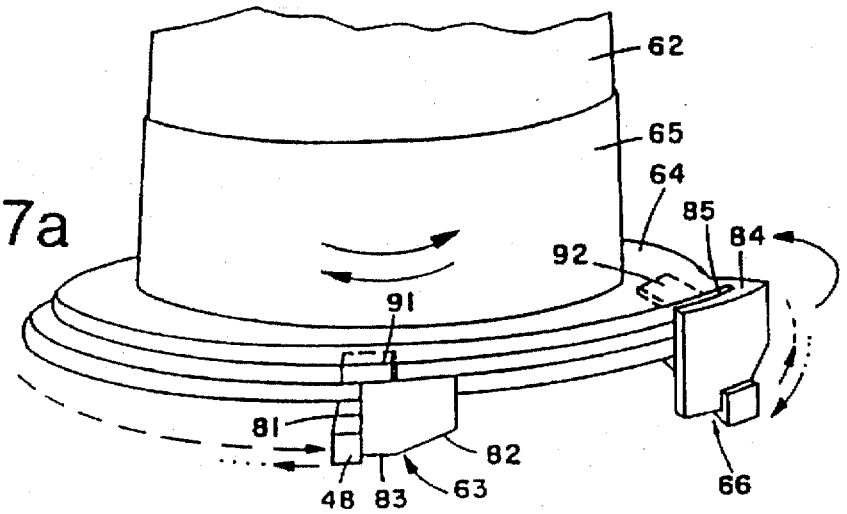
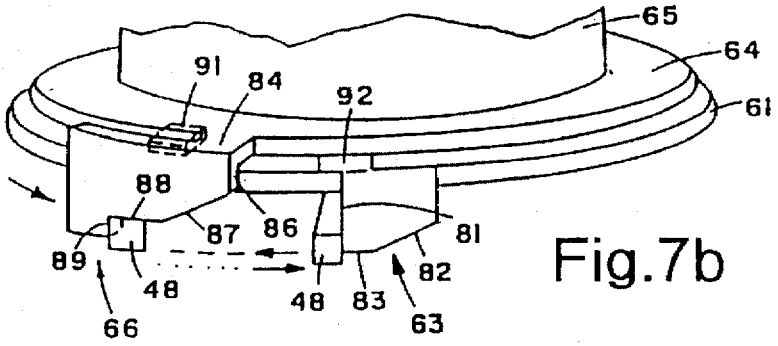
Fig.7b
Fig.7c
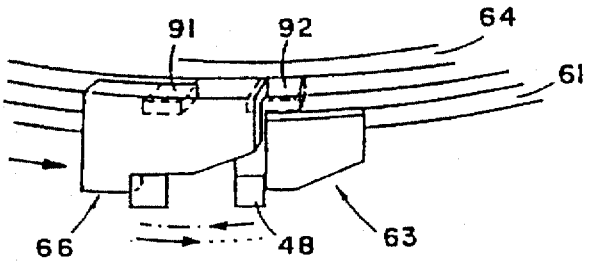
Fig.8
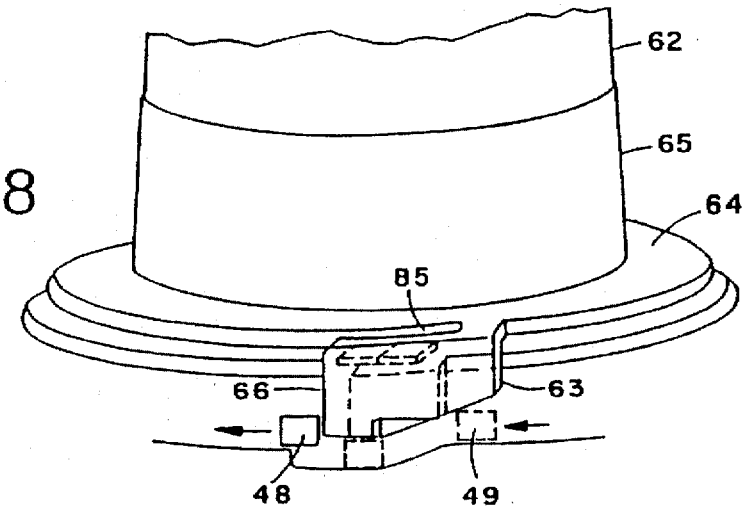

Fi Fig.10b

ROTARY SPRINKLER

FIELD OF THE INVENTION

This invention relates to a rotary drive sprinkler having a rotary drive mechanism driven by an irrigation water supply and having a spray head which can be rotatably driven reversibly within a pre-selected part circular path or, alternatively, through a full circular path. The invention is particularly, but not exclusively, applicable to such a rotary drive sprinkler having a pop-up spray head.

BACKGROUND OF THE INVENTION

Such rotary drive sprinklers have been previously proposed with various means for ensuring the imparting of the rotary drive to the sprinkler, and for ensuring the reversal of the direction of drive each time the spray head reaches one of the predetermined limits of its part circular path. It has long been recognized that the mechanisms used to ensure such operation of the sprinklers are sensitive and are liable to malfunction as a result of prolonged exposure to the elements and to the accumulation of grit, etc. Furthermore, it has also been recognized that these known mechanisms lend themselves to unauthorized tampering and even vandalism, which can again lead to malfunctioning and to breakdown.

Various proposals have been made so as to cope with these problems, among which is the rotary drive sprinkler of the pop-up kind described in U.S. patent specification Ser. No. 4,625,914.

these prior proposals, whilst constituting a distinct improvement over what was previously known, nevertheless only partially cope with the problems which they set out to solve, and are all based on a mechanism which involves reversing the direction of water supply input into the drive mechanism when the direction of drive of the spray head is to be reversed.

It is an object of the present invention to provide a new and improved rotary drive sprinkler.

SUMMARY OF THE INVENTION

According to the present invention there is provided a rotary drive sprinkler comprising a housing for coupling to an irrigation water supply. The sprinkler also includes a sprinkler spray head rotatably mounted with respect to the housing and flow coupling to the supply, and a rotary drive mechanism located within the housing so as to be driven by the water supply. A transmission mechanism, coupled to the drive mechanism, has first and second, oppositely directed, rotary outputs. A reversing mechanism includes:

(i) a stop assembly having stop members arcuately displaceable with respect to each other between a juxtaposed position and a variable spaced apart position, and (ii) a trip assembly responsively juxtaposed with respect to said stop members so as to be reversibly displaced by successive contacting with said stop members only when the latter are in their angularly spaced apart position.

One of these assemblies is rotationally driven by the drive mechanism.

The reversing mechanism also includes (iii) selective coupling means responsively coupled to said trip assembly for coupling to one or the other of said outputs respectively in response to the reversible displacement of said trip assembly; and a drive member coupled to said spray head and to said coupling means so as to be rotationally driven about a drive axis.

Thus, with such a rotary drive sprinkler in accordance with the invention, the transmission mechanism which serves to impart the rotary drive to the sprinkler spray head, is characterized by having a pair of oppositely-directed rotary outputs which are selectively coupled to the spray head in such a manner that the direction of rotational displacement of the spray head reverses each time it reaches the predetermined arcuate limit. On the other hand, by virtue of the provision of the sprinkler with a reversing mechanism having stop members which are arcuately displaceable with respect to each other between a juxtaposed position and a variable spaced-apart position it is ensured that, when desired, the spray head is capable of full circular rotation or part circular rotation.

Preferably, the transmission mechanism comprises an epicyclic gear transmission having successively superimposed, coaxially mounted fixed and first and second rotatably displaceable, internally geared rings of substantially equal pitch diameters, said first and second gear rings are relatively rotatable with respect to each other and with respect to said fixed gear ring; a planetary gear having a rotary axis parallel to that of the first and second gear rings and having a first pitch module $m_1$ substantially equal to that of the fixed gear ring, one of said relatively displaceable gear rings having a second pitch module $m_2$ less than $m_1$, whilst the other of said relatively displaceable gear rings having a third pitch module $m_3$ greater than $m_1$, said planetary gear having an axial extent at least equal to that of the superimposed gear rings so as to intermesh therewith; said first and second gear rings being formed with external gearing for selective coupling to selective coupling means and a further gear transmission means coupled to said rotary drive mechanism for rotatably displacing said planetary gear axis with respect to said fixed gear ring so as to induce in said one gear ring a rotary movement in one sense and so as to induce in said other gear ring a rotary movement in an opposite sense.

In accordance with a preferred embodiment of the present invention, one of the second and third gear rings is formed with one extra tooth as compared with those of the first gear ring, whilst the other gear ring of the second and third gear rings is formed with one tooth less than the number of teeth including in the first gear ring.

By means of what is believed to be a unique transmission mechanism, two oppositely—directed rotary outputs are available for selective coupling to the spray head.

Furthermore, by nature of the particular stop assembly forming part of the reversing mechanism, the arcuative displacement of the constituent stop members of the stop assembly can be readily adjusted without the adjustment mechanism being exposed to the elements and to grit, or to unauthorized tampering.

In accordance with still another embodiment said transmission mechanism comprises a speed reducing gear train; successively superimposed and coaxially mounted first ring assembly engaged with an output of said gear train and rotatable in a first direction, a direction reversing mechanism engaged with said first gear ring assembly and a second gear ring assembly also engaged with said direction reversing mechanism, whereby said second gear ring assembly is rotatable in a second direction respectively opposed to said first direction of said first gear ring assembly.

BRIEF DESCRIPTION OF THE DRAWINGS

For a better understanding of the present invention, and to show how the same may be carried out in practice, reference will now be made to the accompanying drawings, in which:

FIGS. 5*a* and 5*b* are respective plan views from below of the trip assembly shown in FIG. 4, together with selective coupling means shown respectively coupled to one or other of second and third gear rings;

FIGS. 7*a*, 7*b* and 7*c* are perspective views on an enlarged scale of a portion of the stop assembly shown in FIG. 6, with the constituent stop members respectively located at varying arcuate displacements with respect to each other;

FIG. 8 is a perspective view on an enlarged scale of the stop assembly shown in FIG. 6, with the stop members shown in a juxtaposed position;

DETAILED DESCRIPTION OF PREFERRED EMBODIMENT

Figure 1:
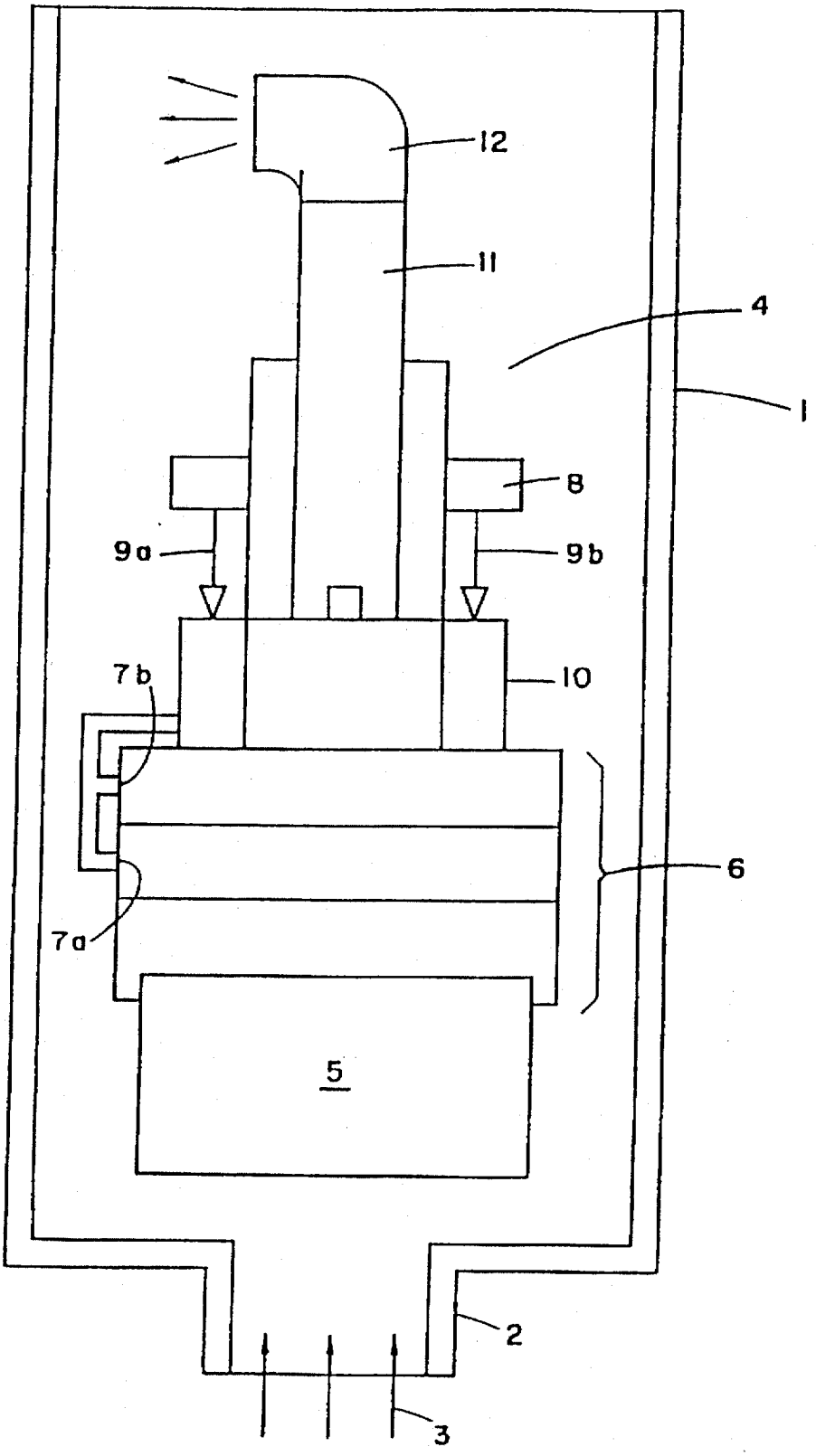
FIG. 1 is a schematic block diagram of a rotary drive sprinkler in accordance with the present invention.

Reference will first be made to FIG. 1 of the drawings, which shows schematically the essential constituents of a pop-up rotary sprinkler in accordance with the invention. As seen in the figure, the pop-up sprinkler comprises a substantially cylindrical housing 1 formed at its base with a water supply inlet 2 through which is adapted to flow an irrigation water supply 3. Located within the housing 1 is a pop-up mechanism 4 which is normally biassed within the housing 1 but, upon the application of water supply pressure through the inlet 2, is displaced upwardly. The pop-up mechanism comprises a rotary drive mechanism 5, a transmission mechanism 6 coupled to the drive mechanism 5 and having first and second oppositely-directed rotary outputs 7*a* and 7*b*. The mechanism 4 furthermore comprises a reversing mechanism 8 with stop members 9*a* and 9*b* which are arcuately displaceable with respect to each other between a juxtaposed position and a variable, spaced-apart position. The mechanism is furthermore provided with a trip assembly 10 which is responsively juxtaposed with respect to the stop members 9*a* and 9*b* so as to be reversibly displaced by successive contacting with the stop members 9*a* and 9*b* only when the latter are in their angularly spaced-apart positions. Either the trip assembly 10 or the reversing mechanism 8 is rotationally driven by the drive mechanism 5. The mechanism 4 is furthermore provided with a drive member 11 which is coupled, on the one hand, to a spray head 12 and, on the other hand, via the rotary outputs 7*a* and 7*b* to the drive mechanism 5.

Figure 2:
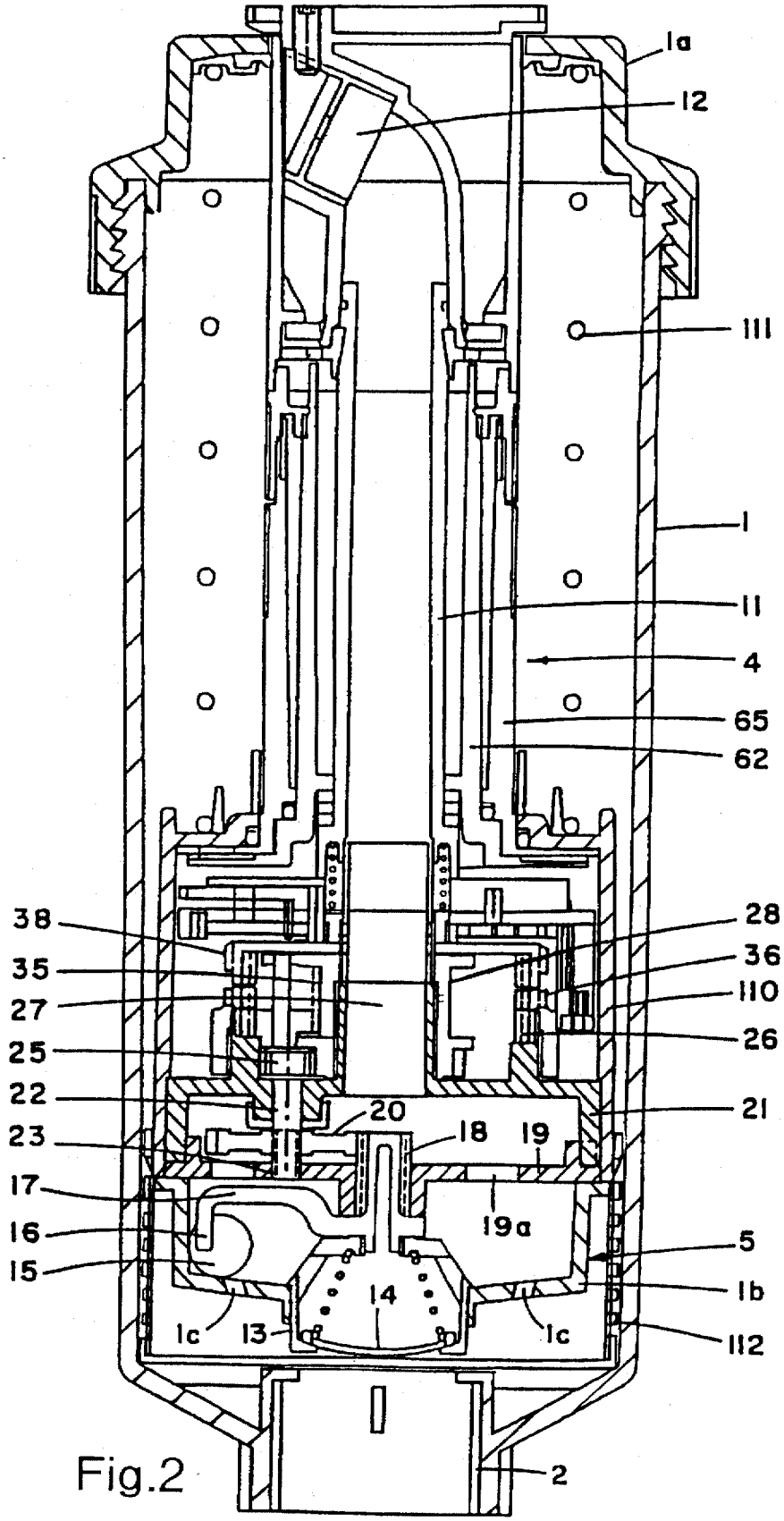
FIG. 2 is a longitudinally-sectioned detailed view of the rotary drive sprinkler shown schematically in FIG. 1.
Figures 3, 3A, 3B, 3C:
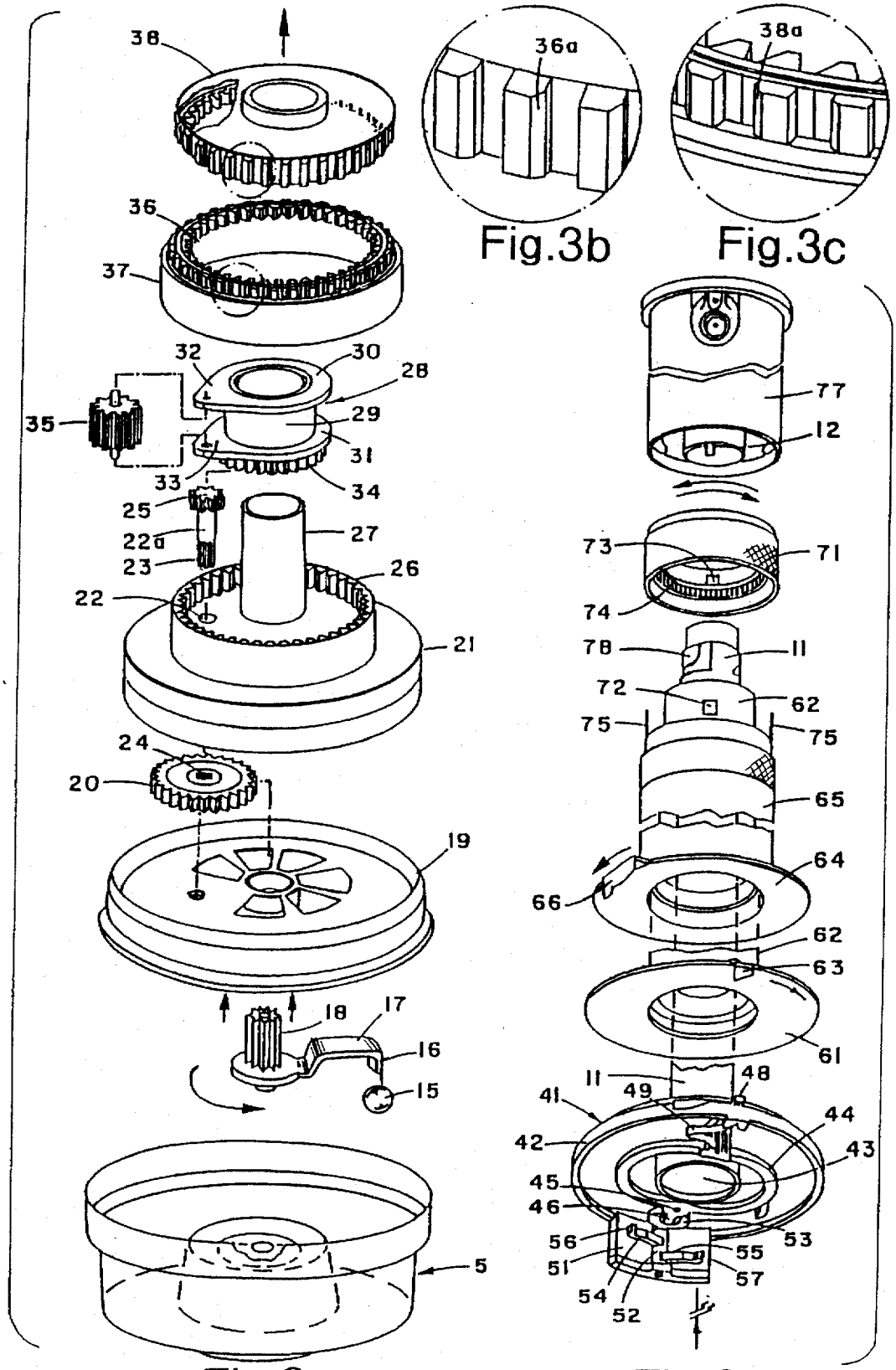
FIG. 3 is a perspective, exploded view showing in detail the constituent elements of the rotary drive sprinkler shown in FIG. 1, apart from the sprinkler housing.
FIG. 3*a* and 3*b* show perspective views on an enlarged scale of details of gear rings shown in FIG. 3.

Reference will now be made to FIGS. 2 and 3 of the drawings for a detailed description of the construction of the pop-up rotary drive sprinkler in accordance with the invention, shown schematically in FIG. 1.

The housing 1 is provided with an upper, centrally-apertured closure cap 1*a*. A cylindrical, cup-like casing 1*b* is formed in a base portion thereof with a plurality of tangentially-directed water inlet ports 1*c* which, as can be seen, are in communication with the inlet 2 of the housing 1. Depending downwardly from the base of the casing 1*b* is an open-ended port 13 provided with a spring biassed closure member 14, such that the port 13 is normally closed.

Located within the casing 1*b* and rotatable therein in response to the tangential inflow of irrigation water via the tangentially-directed inlets ports 7*c* is a steel ball 15 which, upon rotation, impacts one end 16 of a rotational drive arm 17, an opposite end of which is formed integrally with a geared drive shaft 18. The latter passes slidably through a non-rotatable base member 19 so as to mesh with a gear wheel 20 rotatably mounted on the base member 19 which is provided with water apertures 19*a*.

Superimposed on the base member 19 and rotatably fixed with respect to the housing 1 is a cover member 21 which fits onto the base member 19. Rotatably extending through an aperture 22 formed in the cover member 21 is a shaft 22*a* having a lowermost end 23 which is keyed within a correspondingly keyed bore 24 formed in the gear wheel 20. Formed integrally with the upper end of the shaft 22 is a pinion gear wheel 25.

Fixedly and coaxially mounted on an upper surface of the cover member 21 is a fixed, internally-geared gear ring 26. Also fixedly and coaxially mounted on the upper surface of the cover member 21 and extending beyond the fixed gear ring 26 is a tubular hub 27.

The fixed gear ring 26 has a pitch diameter d and a pitch module $m_1$ and a number of gear teeth $n_1$.

Rotatably mounted on the tubular hub 27 is a rotatable collar member 28 having a central, tubular portion 29 formed with upper and lower axially spaced-apart flanges 30 and 31, respectively formed with mounting lugs 32 and 33. Formed integrally with the lower surface of the flange 31 is a gear wheel 34 which meshes with the pinion member 25 so as to rotatably drive the collar member 28 in response to the rotation of the pinion member 25.

Journalled between the lugs 32 and 33 is an axially-elongated, planetary gear wheel 35 having a pitch module $m_1$ substantially equal to that of the fixed first gear ring 26.

A rotationally displaceable second gear ring 36 is formed integrally with an upper surface of a support ring 37 and is mounted on the fixed gear ring 26. The gear ring 36 is formed with internal gearing having a pitch diameter substantially equal to that of the fixed gear ring 26 and having a pitch module slightly greater than that of the fixed gear ring 26 (arising out of the fact that the gear ring 36 has a number of gear teeth $n_2$ slightly less (preferably one less) than the number $n_1$ of the gear teeth of the fixed gear ring 26. The second gear ring 36 is also formed with external gearing, the shape of the gear teeth being shown on an enlarged scale in FIG. 3*a* of the drawings.

A second, rotatably-displaceable gear ring 38 is superimposed on the first rotatable gear ring 36 and is rotatably mounted on the hub 27 so as to be independently rotatable with respect to the first rotatable gear ring 36. The second rotatable gear ring 38 has a pitch diameter substantially equal to those of the first rotatable gear ring 36 and the fixed gear ring 26 but is provided with internal gearing having a pitch module slightly greater than that of the fixed gear ring 26 and therefore also greater than that of the rotatable gear ring 36. This occurs because the number of teeth of three of the internal gearing of the rotatable gear ring 38 is greater than that of the fixed gear ring 26 (preferably one gear tooth more).

The second, rotatably-displaceable gear ring 38 is formed with external gearing, the shape of the external gear teeth being shown in greater detail in FIG. 3*b* of the drawings.

As can be seen in FIGS. 3*a* and 3*b* of the drawings, the external gear teeth of the first and second gear rings 36 and 38 are formed with sloping faces 36*a* and 38*a* which are respectively oppositely directed for a purpose to be described below.

The axial extent of the planetary gear 35 is such that it effectively meshes with the internal gearing of the fixed gear ring 26 and the successive, rotatably-displacing gear rings 36 and 38.

Reference will now be made, in addition to FIGS. 2 and 3 of the drawings, to FIGS. 4, 6, 7 and 8 for a detailed description of the reversing mechanism. As seen in FIG. 3 and particularly in FIG. 4, the trip assembly is formed integrally with a lower end of the tubular drive member 11 and comprises a disc-like base member 41 having a downwardly-depending skirt 42. A central aperture 43 is formed in the base member 41 which communicates with the interior of the tubular drive member 11. Surrounding the circular aperture 43 is a substantially elliptical coupling member 44 which is pivotally mounted with respect to the base member 41 about a pivotal axle 45, in the region of which, the coupling member 44 is integrally formed with a projecting member 46. The coupling member 44 is integrally formed at a location thereof diametrically opposite the axle 45 with an elongated abutment member 47 having an abutment tip 48.

Figure 4:
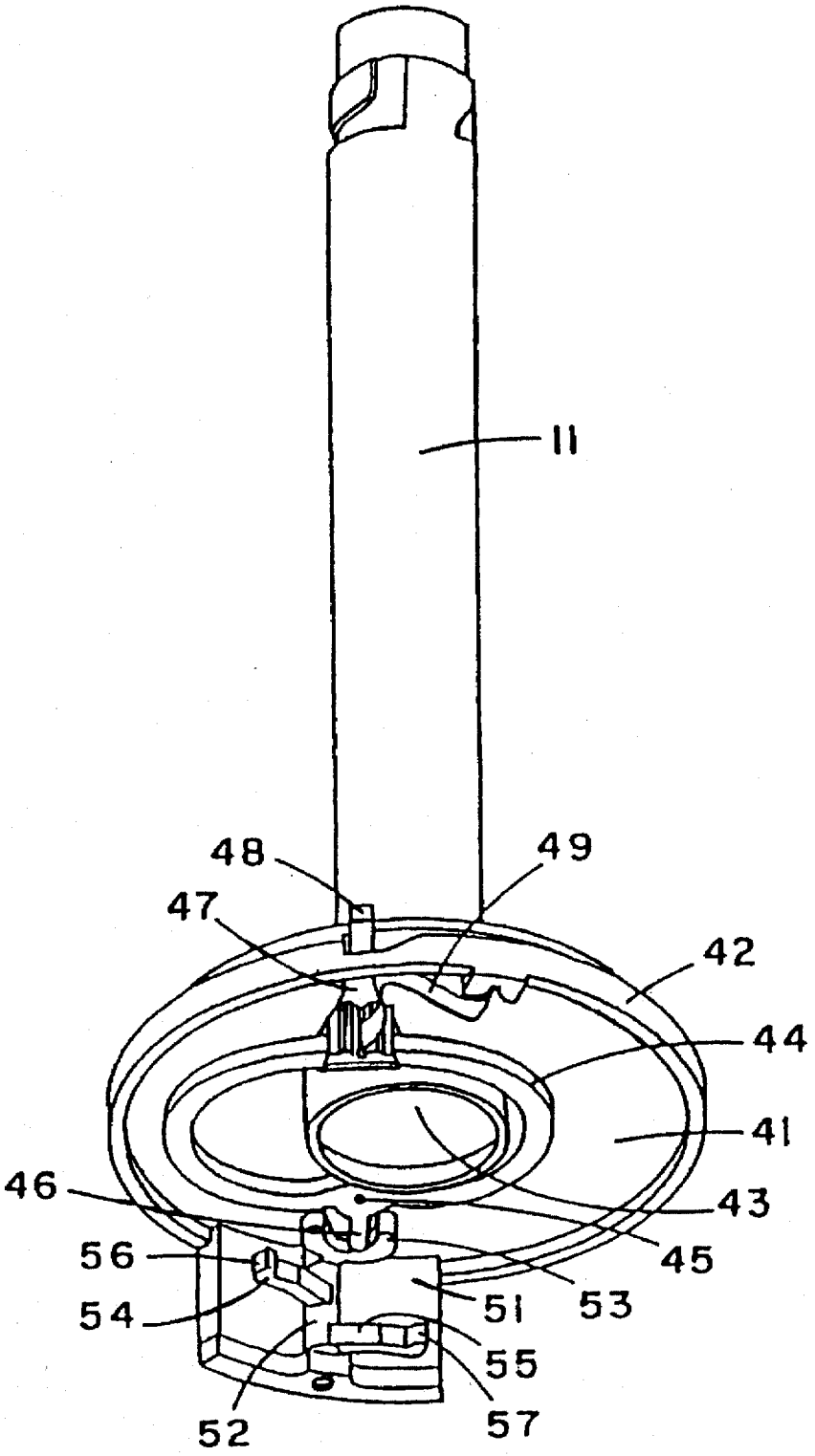
FIG. 4 is a perspective view of a drive member and trip assembly utilized in the rotary drive sprinkler.
Figure 6:
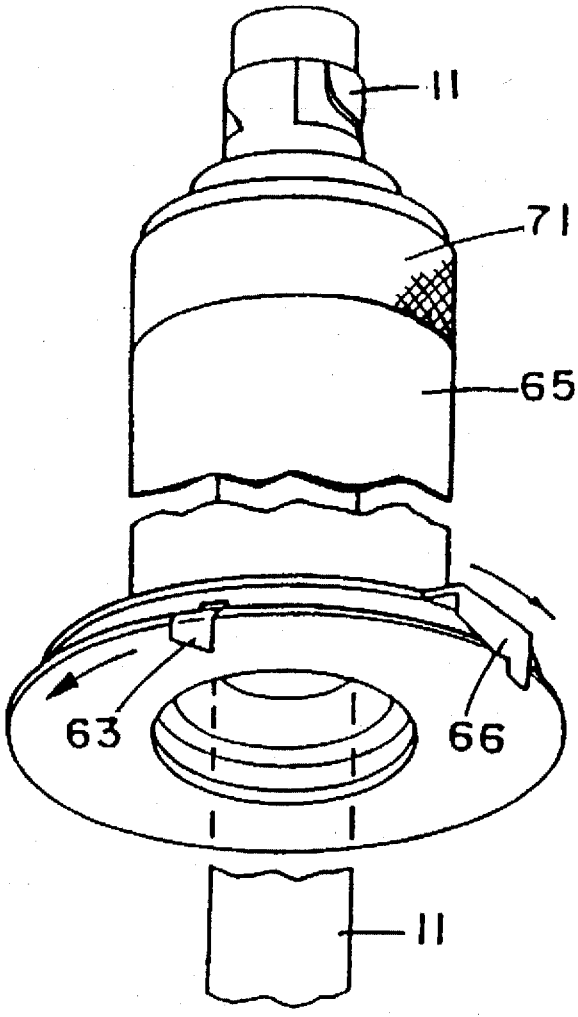
FIG. 6 is a perspective view of the assembled components of the stop assembly shown in exploded view in FIG. 3.

As can be seen in FIG. 4 of the drawings, an Ω-shaped biassing spring 49 is anchored at one end thereof to the skirt 42 of the base member 41 and, at the other end thereof, to the coupling member 44 in the region of the abutment member 47.

The abutment member 47 projects through the skirt 42 via an elongated slit formed therein.

The provision of the biassing Ω-spring 49 ensures the substantially instantaneous displacement of the abutment member 47, under the circumstances to be described below, into either end of the extremity of the slit formed in the skirt 42.

Formed integrally with the skirt 42 is a support member 51 in which is journalled a rotary axle 52 with which is formed integrally at an upper portion thereof, disposed adjacent the base member 41, a U-shaped toggle member 53 into which extends the projecting member 46. Also formed integrally with the axle 52 and axially spaced therealong is a pair of angularly displaced coupling arms 54 and 55, having tooth-shaped coupling tips 56 and 57, the latter being adapted to engage in a manner to be described below, respectively in the external gearing of the gear rings 38 and 36.

Reference will now be made to FIGS. 3, 6, 7*a*, 7*b*, 7*c* and 8 of the drawings for a description of the stop assembly of the reversing mechanism.

As seen in these figures, the stop assembly comprises a first annular support member 61 constituting an outwardly-directed, lower flange of a cylindrical support member 62, coaxial with and surrounding the tubular drive member 11. Formed integrally with and downwardly depending from the rim of the annular support member 61 is a first stop member 63.

A second annular support member 64 is formed integrally with and constitutes an outwardly-directed lower flange of a cylindrical support member 65 coaxial with and surrounding the cylindrical support member 62. Formed integrally with and downwardly depending from the rim of the annular support member 64 is a second stop member 66.

The coaxial, cylindrical support member 62 and 65 interfit relatively tightly but nevertheless allow for relative rotation between them. The interfitted support members, with their projecting stop members 63 and 66, are supported vis-á-vis the tubular drive member 11, so as to allow for the relative rotation of the latter with respect to the support members.

Turning ring 71 is coupled to the upper end of the support member 62 and is keyed thereto by virtue of interengagement of projections 72 on the end of the support member 62 within corresponding recesses 73 on the inner surface of the turning ring 71. The inner surface of the turning ring 71 is provided with a peripheral serrated portion 74 which cooperates with projecting pins 75 secured to the outer tubular support 65, so that upon rotation of the turning ring 71 with respect to the outer tubular support 65, a clicking noise is heard. The outer surface of the turning ring 71, as well as the adjacent outer surface of the tubular support 65, are knurled so as to facilitate easy gripping and relative turning of the two components.

The spray head 12 is located within a cylindrical casing 77 and is coupled to the upper end of the drive member 11 by a bayonet-like coupling 78.

Reference will now be made to FIGS. 6, 7*a*, 7*b*, 7*c* and 8 of the drawings for a more detailed description of the form and construction of the stop members 63 and 66. As can be seen, the stop member 63 is formed with a vertically disposed stop surface 81 and a lower ramp surface 82 and an intermediate bridging, substantially horizontal surface 83. The stop member 66, on the other hand, is located radially outwardly with respect to the location of the stop member 63 and is coupled to the adjacent annular surface 64 via a radially-directed bridging portion 84, the major portion of the stop member 66 being separated from the adjacent annular support surface 64 via a spacing 85. The sop member 66 is formed in the region thereof adjacent the stop surface 81 of the stop member 63 with an initial, vertically-disposed surface 86 formed integrally with the bridging member 84, an intermediate ramp surface 87 substantially parallel to the ramp surface 82, an intermediate, horizontal bridging surface 88 and a terminal, vertically-disposed stop surface 89.

Projecting outwardly from peripheral portions of the annular support members 61 and 64 are respective limiting members 91 and 92. As can be seen in the drawings, the abutment tip 48 projecting out of the slot formed in the descending skirt, is interposed between the stop surfaces 81 and 89 of the stop members 63 and 66 and, in consequence, the relative position of these stop members 63 and 66 determines the degree of movement of the abutment member 47 between the stop members 63 and 66.

Figure 9A:
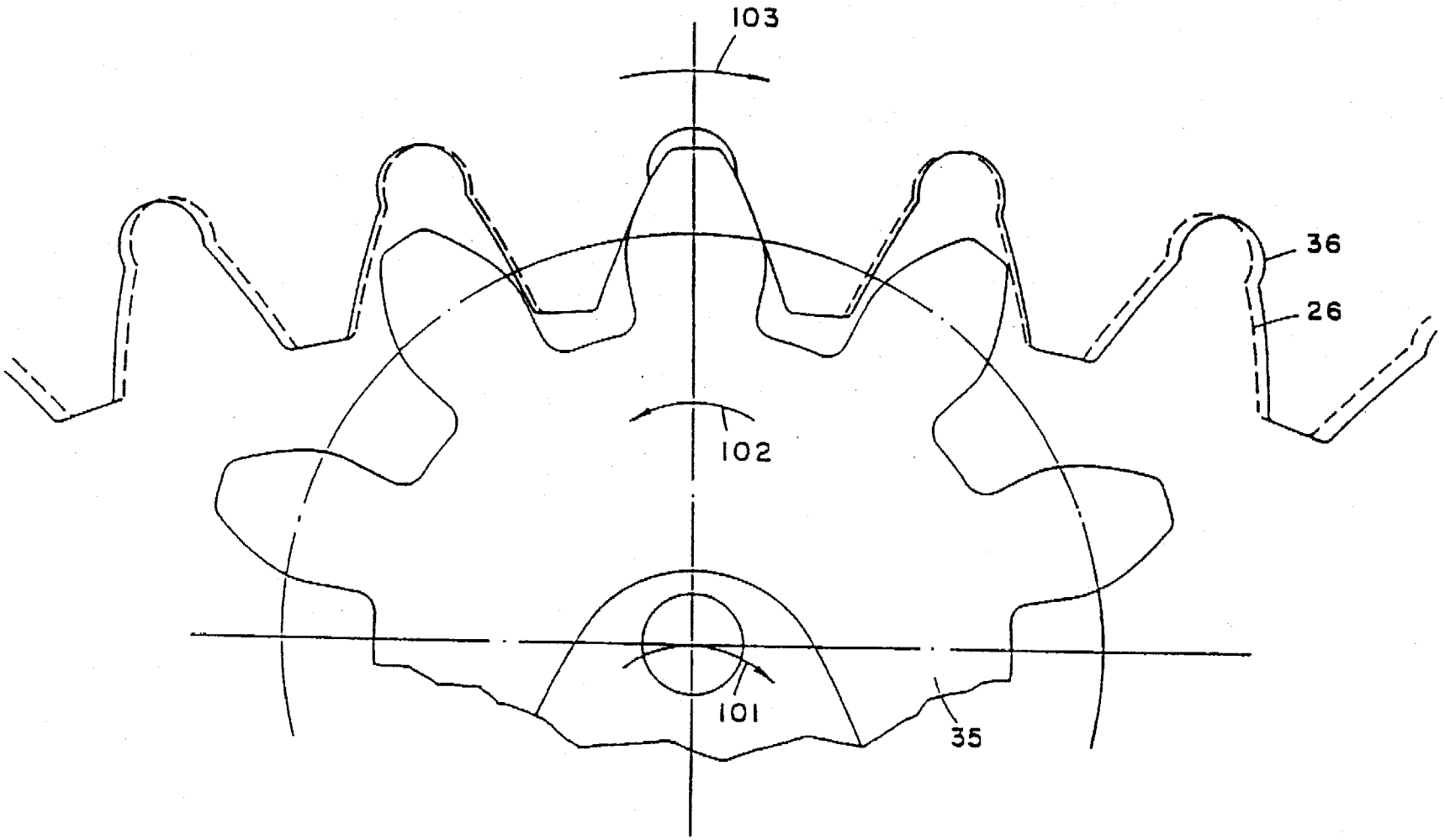
FIGS. 9*a* and 9*b* show respectively the meshing of a planetary gear wheel of the transmission mechanism with first and second superimposed, relatively rotatable gear rings.
Figure 9B:
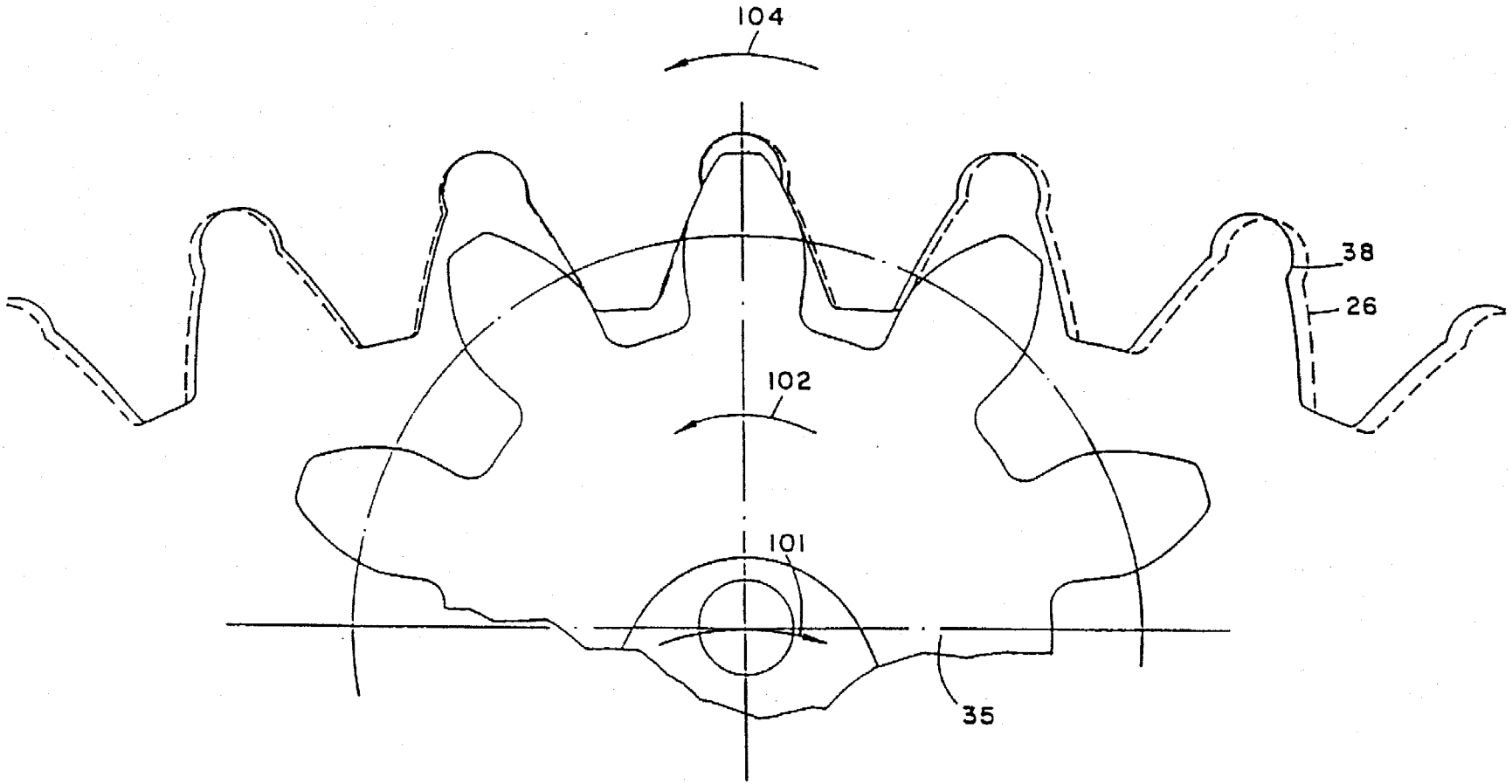

Reference will now be made to FIGS. 9*a* and 9*b* of the drawings for a description of the manner in which rotary outputs in opposite directions can be obtained from the first and second rotatably-displaceable gearings 36 and 38.

As has been stated above, the gear ring 36 has a higher pitch module than has the fixed gear ring 26 (which is shown in the figure in dashed lines as compared with the displaceable gear ring 36 which is shown in full lines). This is in view of the fact that the displaceable gear ring 36, whilst having the same pitch diameter as the fixed gear ring 26, nevertheless has a lesser number of teeth. In the example at present being described, whilst the fixed gear ring 26 has 43 teeth, the displaceable gear ring 36 has 44 teeth. As can be seen in FIG. 9*a*, the axis of the planetary gear 35 moves about the axis of the casing in the direction of an arrow 101, whilst the planetary gear 35 itself rotates about its axis in the direction of the arrow 102. In consequence of the meshing of the planetary gear with the fixed gear ring 26, on the one hand (having the same pitch module), and with the displaceable gear ring 36, on the other hand, having a greater pitch module, the displaceable gear ring 36 moves slowly in the direction of the arrow 103.

If now we consider the situation illustrate din FIG. 9*b*, where the planetary gear meshes, on the one hand, again with the fixed gear ring 26 and now with the displaceable gear ring 38, having a lesser pitch module than that of the fixed gear ring 26 (the gear ring 38 has 44 teeth as compared with the 43 teeth of the fixed gear ring 26), the displaceable gear ring 38 now moves in the direction of the arrow 104 which is opposite to the direction of the arrow 103. In other words, rotary outputs are obtained from the displaceable gear rings 36 and 38 in respectively opposite senses.

The constituent components of the rotary drive pop-up sprinkler just described are assembled together within the casing 1 as shown in FIG. 2 of the drawings. Thus, the rotary drive mechanism together with the transmission mechanism are incorporated in a cylindrical casing 110, from an upper end of which projects the coaxial, cylindrical support members 62 and 65 and drive member 11, and the lower end of which is integrally coupled to the drive motor casing 5. A coiled compression spring 111 surrounds the coaxial support members and bears, at a lower end thereof, against an upper surface of the casing 110 and, at an upper end thereof, against the closure cap 1*a* through which the spray head 12 is adapted to project.

Surrounding the lower end of the drive motor casing is a cylindrical filter housing 112, through which all the supply water passing into the housing must pass.

Clearly, the sprinkler arrangement just described is provided with appropriate packings and sealing rings so as to ensure leak-free connections and that grit does not enter the transmission mechanism. Whilst these sealing means and packings are illustrated in FIG. 1, they will not be described in any detail.

In normal operation, with the housing 1 buried in the ground so that only the upper aperture of the cap 1*a* is exposed, the flow of water through the inlet 2 overcomes the biassing effect of the compression spring 111 and displaces the mechanism casing 110 upwardly so as to expose the spray head 12. The irrigation water entering the rotary drive mechanism casing 11*a* through the tangentially-directed apertures 12 causes the ball 15 to rotate within the casing, impacting the drive arm 16 and thereby transmitting a rotary drive via the gear shaft 18, gear wheel 20, pinion 25, gear wheel 34 to the planetary gear 35 and from the planetary gear 35 to the gear rings 36 and 38. As has been explained above, this rotary drive apply to these gear wheels results in the gear wheels moving in opposite senses, thereby generating a drive output from the gear wheels in respectively opposite senses and at reduced speeds as compared with the input speed of the arm 17. One or other of the gear rings 36 and 38 will be coupled to the drive member 11, giving rise to the rotation of the drive member 11, the consequent rotation of the tripping mechanism and the rotation of the spray head. The sense of rotation of the spray head will, of course, depend on which of the gear rings 36 and 38 is coupled to the drive member 11 via one or other of the coupling arms 54 and 55.

With the rotation of the tripping mechanism, the abutment tip 48 moves within the slot in one or other direction until its abuts one or other of the stop surfaces 81 or 89. Upon abutting of a stop surface, the abutment member 47 is switched under the influence of the Ω-shaped spring 49 so that the lever 46 rotates into displacing the toggle member and arranging for the other one of the coupling arms to be coupled to the other one of the displaceable gear rings, thereby ensuring movement of the spray head in the opposite sense.

FIG. 7*a*, 7*b* and 7*c* show the relative positions of the stop members for differing arcuate extents for the irrigated areas. Thus, for example, as shown in FIGS. 7*a* of the drawings, the abutment tip 48 moves over the major portion of a circular path between stop members 89 and 81.

In order to shorten the arcuate extent of the irrigated portion, the stop member 63 is moved in an anti-clockwise direction into the position shown in FIG. 7*b* of the drawings and here, as we can see, the abutment tip 48 moves over a very limited arcuate extent.

FIG. 7*c* shows how this extent can be even further limited.

When it is desired to ensure uninterrupted irrigation over a full circular path, the two stop members are brought into a relatively juxtaposed position, as shown in FIG. 8 of the drawings, with the innermost stop member 63 passing into the radial space 85 adjoining the stop member 66 and, as a consequence, the stop surface 89 is no longer effective, there being formed a composite ramp surface consisting of the combined ramps 82 and 87 over which the abutment tip 48 rides in a continuous circular path and continuous full circular rotation will now take place, always in the same sense.

The provision of the limiting abutments 91 and 92 ensures that juxtaposition of the two stop members 63 and 66 takes place in exactly the correct position and also ensures that there is no danger of the abutment tip 48 being trapped between the two juxtaposed stop members.

Determination of the extent of the irrigated arcuate region, and its relative location, can be readily effected by relative rotation of the cylindrical support members 62 and 65, using for this purpose the knurled turning ring and knurled end portion. Ensuring continuous full circular rotation of the spray head is effected by rotation of the cylindrical support members until the position where the abutment limits abut, thereby indicating that the stop members are fully juxtaposed.

In order to enable an operator to establish visually the arcuate extent of the proposed part circular irrigation, the operator can manually rotate the drive member 11 or spray head 12 (without it being coupled to the water supply) in a direction that one or other of the coupling arms 54 and 55 engages the respective gear rings 36 and 38 so as to pass over, in a ratchet-like fashion, the sloping faces 36*a* and 38*a*. In this way, the operator can determine visually the degree of rotation of the spray head 12 between successive reversals of the abutment member 47.

In order to determine the direction (azimuth) of the region to be irrigated, both stop members are rotated so that the line bisecting the angle defined by both stop members is located in the center of the region to be irrigated.

In order to compensate for an increased head loss in the sprinkler arising, for example, out of the use of a large aperture spray nozzle outlet (thereby giving rise to an undesirable reduction in the range and distribution of the outflowing water), it is ensured that when head loss rises beyond a desired maximum, the pressure of the incoming water supply overcomes the counteracting biassing pressure effected by the spring biassed closure 14 and, in consequence, the latter opens and water flows directly through the port 13 as well as flowing via the tangentially-disposed inlet ports 1*c*.

Whilst in the embodiment described above the two-directional drive output has been employed by using displaceable gear rings having numbers of teeth which differ by one from the number of teeth of the fixed gear ring, it will be appreciated that the differential in the number of teeth may be somewhat greater than one and, in fact, the number of teeth in one displaceable gear ring may differ from that in the fixed gear ring by a number which is other than the difference between the number of teeth in the other displaceable gear ring and the fixed gear ring.

Figure 10A:
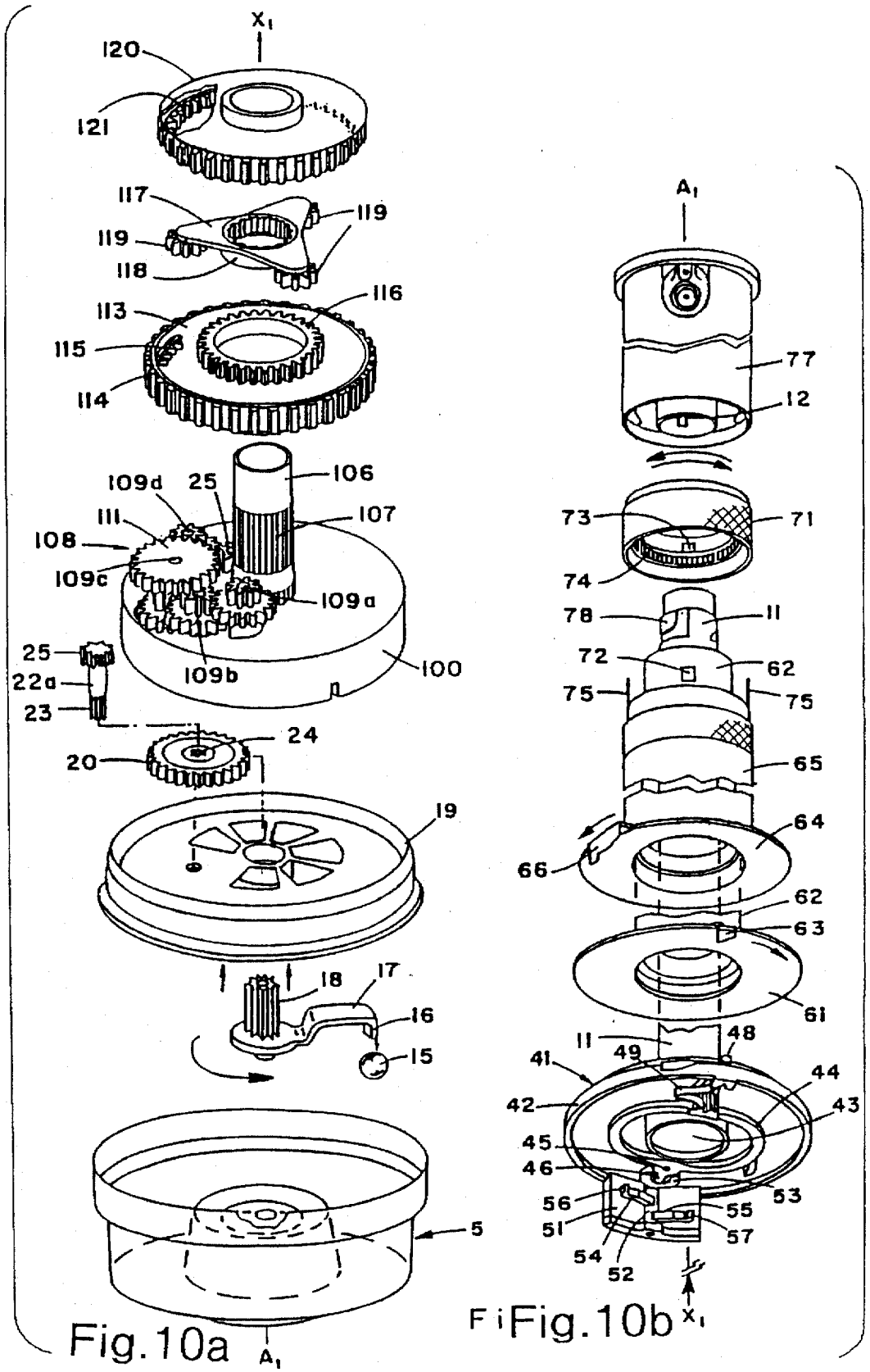
FIG. 10 is a perspective exploded view as in FIG. 3 showing the constituents of a second embodiment of a transmission mechanism for a rotary drive sprinkler according to the present invention and how it associates with the other mechanisms.

Attention is now directed to FIG. 10 of the drawings illustrating a second embodiment of a transmission mechanism useful for the drive sprinkler of the present invention. The other components of the sprinkler, i.e., rotary drive, reversing mechanism, etc. are not altered and they engage with this second embodiment in the same manner as explained in connection with the previous embodiment.

Rotatably extending through an aperture (not shown) formed in a cover member 100 is a shaft 22*a* having a lowermost end 23 which is keyed with a corresponding keyed bore 24 formed in the gear wheel 20. Formed integrally with the upper end of the shaft 22*a* is a pinion gear wheel 25 (partially seen also in its assembled position over cover member 100).

Fixedly and co-axially mounted on the upper surface of the cover member 100 is a tubular hub 106 having a splined portion 107.

Pinion gear wheel 25 drives a speed reduction gear train assembly designated 108 in which a plurality of gears are mounted over shafts 109*a* to 109*d* projecting from the upper surface of the cover member 100, the gears being meshed with one another, whereby the speed of rotation of an output gear 111 is reduced to a predetermined speed as known per se.

A rotatably displaceable first ring 113 is integrally formed with external gearing 114 (the shape of the gear teeth being shown on an enlarged scale in FIG. 3*a* of the drawings) and internal gearing 115 adapted for engaging with the output gear 122 of the gear train 108. The support ring 113 is also integrally formed on its upper surface with an intermediate gearing 116.

Fixedly mounted on the tubular hub 106 of the cover m ember 100 is a planetary gear carrier member 117 having a triangular shape and provided with a central portion 118 internally geared so as to engage the splined portion 107 of hub 106. Said central portion having a diameter suitable for being received within the gearing 116.

At each vertex of the carrier member 117 there is journalled a planetary gear 119, the three gears 119 adapted for meshing with the rearing 116.

A rotatably displaceable second ring 120 is superimposed on the first ring 113 and is rotatably mounted on the hub 106 of the cover member 100 so as to be independently rotatable with respect to the first ring 113. The second ring 120 is formed with internal gearing 121 suitable for engaging with the planetary gears 119 and with external gearing being shown in greater detail in FIG. 3*b* of the drawing.

As already explained in connection with FIGS. 3*a* and 3*b* of the drawings, the external gear teeth of the first ring 113 and the second ring 120 are formed with sloping faces 36*a* and 38*a* which are respectively oppositely directed for a purpose as described hereinbefore.

In operation, as hereinbefore explained, the pinion 25 transmits rotary motion via the gear train 108 and the output gear 122 to the first gear ring 113 in a first direction, whereby the planetary gears 109 transmit rotary motion to the second gear ring 120 in an opposed direction, thereby generating a drive output in respectively opposite directions and at substantially reduced speed as compared with the input speed of the arm 17.

Rotation of the drive member 11 is by coupling it to one or other of the gear rings 113 or 120, giving rise to the consequent rotation of the tripping mechanism and the rotation of the spring head as already explained in detail hereinabove.

I claim:

1. A rotary drive sprinkler comprising:

a housing for coupling to an irrigation water supply;

a sprinkler spray head rotatably mounted with respect to said housing and flow coupled to said supply;

a rotary drive mechanism located within said housing so as to be driven by said water supply;

a transmission mechanism coupled to said drive mechanism and having first and second, oppositely directed, rotary outputs;

a reversing mechanism including:

(i) a stop assembly having stop members arcuately displaceable with respect to each other between a juxtaposed position and a variable spaced apart position;

(ii) a trip assembly responsively juxtaposed with respect to said stop members so as to be reversibly displaced by successive contacting with said stop members only when the latter are in their angularly spaced apart position;

one of said assemblies being rotationally driven by said drive mechanism;

(iii) selective coupling means responsively coupled to said trip assembly for coupling to one or the other of said outputs respectively in response to the reversible displacement of said trip assembly; and a drive member coupled, to said spray head and, to said coupling means so as to be rotationally driven about a drive axis.

2. A rotary drive sprinkler according to claim 1, wherein said trip assembly is rotationally driven by said drive mechanism.

3. A rotary drive sprinkler according to claim 1, wherein said trip assembly comprises an abutment member and wherein said selective coupling means comprises integrally displaceable coupling elements and spring biassed coupling means coupling said abutment member to said coupling elements so as to displace one or other of said coupling elements into engagement with one or other of said outputs in response to reversible displacement of said abutment member.

4. A rotary drive sprinkler according to claim 3, wherein said coupling elements are integrally secured at one adjacent pair of ends thereof to a rotatably mounted axle and are formed, at an opposite pair of ends thereof, with engagement means for respectively and alternately engaging said outputs; said spring biassed coupling means being coupled to said axle for rotatably displacing said axle.

5. A rotary drive sprinkler according to claim 4, wherein said spring biassed coupling means is constituted by a coupling member formed integrally at a first position thereof with said abutment member and, at a second remote position thereof, is articulated to said axle and spring biassing means coupled to said coupling member for biassing said axle into first and second positions in response to the reversible displacement of said abutment member, the arrangement being such that biassing displacement of the axle into said first position results in the engagement of a first coupling element with a first of said outputs whilst biassing displacement of the axle into said second position results in the engagement of a second coupling element with a second of said outputs.

6. A rotary drive sprinkler according to claim 1, wherein said stop assembly comprises first and second successive, annular support members respectively mounted for independent rotation with respect to said drive axis with said stop members formed integrally with and respectively depending therefrom; said first stop member being radially spaced from said drive axis by an amount which exceeds a corresponding radial spacing of said second stop member from said drive axis whereby said second stop member is displaceable into a region inwardly of said first stop member with respect to said drive axis into said juxtaposed position.

7. A rotary drive sprinkler according to claim 6, wherein said first stop member is formed with a first inclined ramp surface and an arcuately spaced apart stop surface depending downwardly with respect to said first inclined ramp surface, said second stop member is formed with a second, inclined ramp surface substantially parallel to said first inclined ramp surface and an arcuately spaced apart second stop surface, such that when said stop members are in their juxtaposed position said first and second ramp surfaces are substantially coplanar, forming a composite inclined ramp surface; the arrangement being such that with said stop members in said arcuately spaced apart position said abutment member is successively and reversibly displaceable between said first and second stop surfaces whilst when said stop members are in the juxtaposed position, said abutment member is continuously displaceable in a given sense passing over the composite inclined ramp surface.

8. A rotary drive sprinkler according to claim 7, wherein said annular support members constitute respective outwardly directed flanges of first and second tubular control members surrounding and substantially coaxial with said drive member and rotatably displaceable with respect thereto and with respect to each other so as to vary the relative, arcuate spacing between said stop members.

9. A rotary drive sprinkler according to claim 8, wherein said tubular support members are integrally formed with limiting abutments for limiting the minimum arcuate spacing between said first and second stop surfaces.

10. A rotary drive sprinkler according to claim 1, wherein said transmission mechanism comprises an epicyclic gear transmission having successively superimposed, coaxially mounted fixed and, first and second rotatably displaceable, internally geared rings of substantially equal pitch diameters, said first and second gear rings are relatively rotatable with respect to each other and with respect to said fixed gear ring; a planetary gear having a rotary axis parallel to that of the first and second gear rings and having a first pitch module $m_1$ substantially equal to that of the fixed gear ring, one of said relatively displaceable gear rings having a second pitch module $m_2$ less than $m_1$, whilst the other of said relatively displaceable gear rings having a third pitch module $m_3$ greater than $m_2$, said planetary gear having an axial extent at least equal to that of the superimposed gear rings so as to intermesh therewith; said first and second gear rings being formed with external gearing for selective coupling to selective coupling means and a further gear transmission means coupled to said rotary drive mechanism for rotatably displacing said planetary gear axis with respect to said fixed gear ring so as to induce in said first gear ring a rotary movement in one sense and so as to induce in said second gear ring a rotary movement in an opposite sense.

11. A rotary drive sprinkler according to claim 10, wherein said planetary gear is rotatably mounted between a pair of lugs formed integrally with a pair of axially spaced apart flanges of a collar member rotatably mounted on a hub integral with a planar base of said first gear ring, said further gear transmission means serving to impart a rotary drive to said collar member.

12. A rotary drive sprinkler according to claim 10, wherein said first gear ring is formed with n teeth, said one gear ring is formed with n+x teeth, said other gear ring is formed with n−x teeth where $x \geqq 1$.

13. A rotary drive sprinkler according to claim 11, wherein said further transmission means comprises a gear train coupled to said drive mechanism and having an output gear meshing with a geared base ring of said collar member.

14. A rotary drive sprinkler according to claim 1, wherein said rotary drive mechanism comprises a water driven turbine.

15. A rotary drive sprinkler according to claim 1, wherein said spray head is mounted on a pop-up assembly displaceable between a retracted position within the housing and an operative position with the spray head elevated out of the housing.

16. A rotary drive sprinkler according to claim 1, wherein said transmission mechanism comprises a speed reducing gear train; successively superimposed and coaxially mounted first ring assembly engaged with an output of said gear train and rotatable in a first direction, a direction reversing mechanism engaged with said first gear ring assembly and a second gear ring assembly also engaged with said direction reversing mechanism, whereby said second gear ring assembly is rotatable in a second direction respectively opposed to said first direction of said first gear ring assembly.

17. A rotary drive sprinkler according to claim 16, wherein said first gear ring assembly consists of a first gear ring and an intermediate gear ring integrally formed on a top surface thereof; said reversing mechanism consists of at least one planetary gear mounted on a fixed planetary gear bearing plate, said at least one planetary gear being engaged with said intermediate gear ring and with an internal gear of said second gear ring assembly.

* * * * *